US006214258B1

(12) United States Patent
Woodward et al.

(10) Patent No.: US 6,214,258 B1
(45) Date of Patent: Apr. 10, 2001

(54) FEED GAS PRETREATMENT IN SYNTHESIS GAS PRODUCTION

(75) Inventors: Donald Winston Woodward, New Tripoli; Arthur Ramsden Smith, Telford, both of PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/132,930

(22) Filed: Aug. 13, 1998

(51) Int. Cl.[7] ..... C07C 1/02; C07C 1/04; C01B 3/24; C01B 3/26

(52) U.S. Cl. ..... 252/373; 423/359; 423/650; 423/651

(58) Field of Search ..... 252/373; 423/650, 423/651, 359

(56) References Cited

U.S. PATENT DOCUMENTS

| | | | | |
|---|---|---|---|---|
| 4,217,759 | * | 8/1980 | Shenoy | 62/27 |
| 4,296,085 | * | 10/1981 | Banquy | 423/359 |
| 4,411,677 | | 10/1983 | Pervier et al. | 62/25 |
| 4,504,295 | | 3/1985 | Davis et al. | 62/30 |
| 4,732,598 | | 3/1988 | Rowles et al. | 62/28 |
| 5,081,845 | | 1/1992 | Allam et al. | 62/24 |
| 5,146,756 | | 9/1992 | Lavin | 62/24 |
| 5,388,395 | | 2/1995 | Scharpf et al. | 60/39.02 |
| 5,617,741 | | 4/1997 | McNeil et al. | 62/622 |
| 5,635,541 | | 6/1997 | Smith et al. | 518/703 |

FOREIGN PATENT DOCUMENTS

| | | | | |
|---|---|---|---|---|
| 331-648 | * | 2/1979 | (SU) | 423/650 |

OTHER PUBLICATIONS

Vines, H., "Upgrading Natural Gas" in *Chemical Engineering Progress,* Nov. 1986, pp. 46–50.

Marriott, J. M. et al., "Shell Middle Distillates Synthesis, The Process, The Products, The Plants", *Alternate Energy* '94 LaQuinta, CA, Apr. 26–29, 1994.

Ansell, L. L. et al., "Liquid Fuels from Natural Gas—An Update of the Exxon Process", *Alternate Energy* '94, LaQuinta, CA, Apr. 26—29, 1994.

Davis, R. A., et al., "Integrated Nitrogen Rejection Facility Design and Operation", *Proceedings of the Sixty–Eighty GPA Annual Convention,* Process Innovations, pp. 204–210.

* cited by examiner

*Primary Examiner*—Steven P. Griffin
*Assistant Examiner*—Jonas N. Strickland
(74) *Attorney, Agent, or Firm*—John M. Fernbacher

(57) ABSTRACT

An air separation system and a partial oxidation system for the production of synthesis gas are integrated wherein the air separation system provides the oxygen for the partial oxidation process and byproduct nitrogen is utilized to generate refrigeration for pretreatment of the partial oxidation feed gas. The partial oxidation feed gas is predominantly methane, and typically is obtained from natural gas which contains lighter components such as nitrogen.

16 Claims, 1 Drawing Sheet

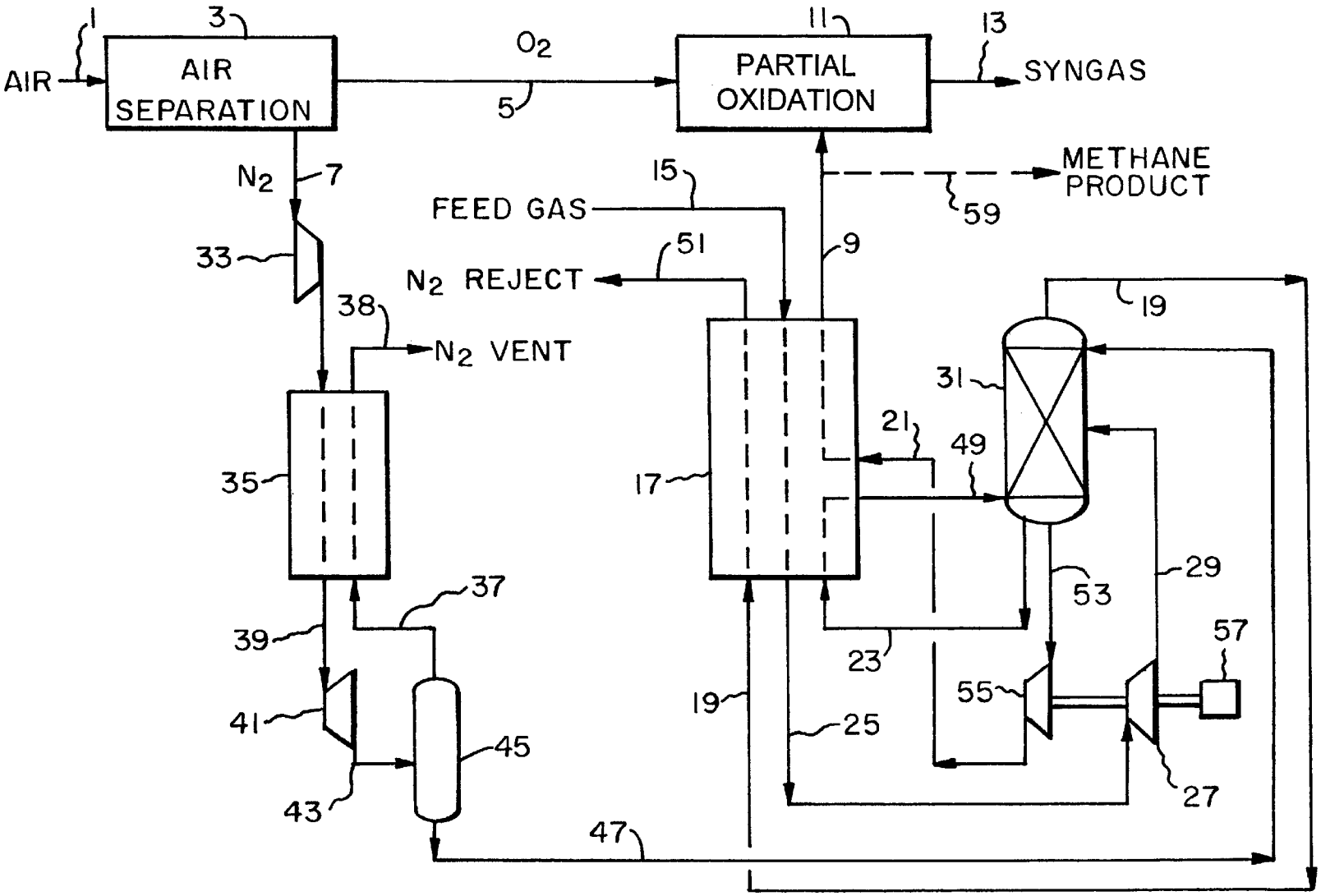
AIR
1
AIR SEPARATION
3
$N_2$
7
33
38
$N_2$ VENT
35
39
41
43
45
37
$O_2$
5
FEED GAS
15
$N_2$ REJECT
51
17
47
19
25
23
21
49
31
53
55
29
57
27
PARTIAL OXIDATION
11
9
59
METHANE PRODUCT
13
SYNGAS

FEED GAS PRETREATMENT IN SYNTHESIS GAS PRODUCTION

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to the production of synthesis gas from natural gas by partial oxidation. Partial oxidation is a widely used process which yields synthesis gas having a hydrogen to carbon monoxide ratio near 2, which is a particularly suitable synthesis gas for the production of methanol, dimethyl ether, heavier hydrocarbons by the Fischer-Tropsch process, and other chemical products. The partial oxidation process uses oxygen provided by an air separation system to convert a wide variety of feedstocks ranging from methane to heavier hydrocarbons into synthesis gas. The efficient operation of the air separation system and integration of the system with the partial oxidation process are important factors in the overall cost of producing synthesis gas.

Natural gas typically contains components which boil above the boiling point of methane such as water, $C_2^+$ hydrocarbons, carbon dioxide, and sulfur-containing compounds. Natural gas also may contain components such as nitrogen and helium which have lower boiling points than methane. The operation of partial oxidation processes using natural gas feed is affected minimally by the presence of components heavier than methane in the feed, so feed pretreatment often is not needed. In some cases it may be desirable to remove sulfur-containing compounds from the feed gas prior to partial oxidation, for example when catalytic partial oxidation is used.

Components in the natural gas feed which are lighter than methane and which act essentially as inert diluents, usually nitrogen and occasionally helium, are undesirable for a number of reasons. These diluents reduce the effective partial pressure of methane in the partial oxidation reactor, increase the volume of feed and product gas to be handled, and dilute the synthesis gas used in downstream processes. Nitrogen may be undesireable in downstream processes for other reasons as well. Thus it will be preferred in certain cases to remove the diluent components from the natural gas feed prior to the partial oxidation reactor system.

Methods for removing nitrogen from natural gas, typically termed nitrogen rejection, are well known in the art as taught by the review article entitled "Upgrading Natural Gas" by H. Vines in *Chemical Engineering Progress*, November 1986, pp. 46–50. Other representative nitrogen rejection processes are disclosed for example in U.S. Pat. Nos. 4,411,677; 4,504,295; 4,732,598; and 5,617,741.

The air separation plant which provides the oxygen for the partial oxidation reactor also produces a nitrogen byproduct, and it is desirable to utilize this nitrogen byproduct when possible to reduce the overall cost of the synthesis gas and the products generated from the synthesis gas.

U.S. Pat. No. 5,635,541 discloses the use of an elevated pressure air separation plant to supply oxygen for natural gas conversion to higher molecular weight hydrocarbons. Elevated pressure nitrogen byproduct gas is utilized in several ways to improve the efficiency of the overall process. In one embodiment, the byproduct nitrogen is cooled by work expansion and contacted with water to produce chilled water used for cooling the air separation unit compressor inlet air. In another embodiment, the byproduct nitrogen is expanded to generate work to produce electricity or for gas compression. In an alternative mode, the nitrogen is heated by waste heat from the natural gas conversion process prior to expansion. U.S. Pat. No. 5,146,756 discloses an elevated pressure air separation system wherein byproduct nitrogen from the cold end of the main heat exchanger is work expanded and reintroduced into the exchanger to provide additional cooling for increased efficiency. Expanded and warmed nitrogen from this step can be used further for cooling at ambient temperatures to replace or reduce the use of cooling water. Alternatively, some of the pressurized ambient temperature nitrogen can be work expanded and further cooled for other uses outside of the air separation system.

It is desirable to reduce the capital and operating cost of a process plant for the partial oxidation of a natural gas feed to synthesis gas by integrating the operation of the air separation unit with the partial oxidation process and optionally with the synthesis gas consuming process. This can be achieved in part by efficient utilization of the nitrogen byproduct from the air separation system, particularly when this system generates a nitrogen byproduct at above atmospheric pressure. When the natural gas feed contains significant amounts of lower boiling components such as nitrogen, it is often desirable to pretreat the feed to remove this nitrogen, thereby reducing downstream equipment size and gas handling requirements. The invention described below and defined by the claims which follow offers an efficient method of integrating the air separation unit with the partial oxidation process by removing nitrogen from the natural gas feed utilizing byproduct nitrogen from the air separation unit.

BRIEF SUMMARY OF THE INVENTION

The invention is a method for producing synthesis gas which comprises separating an air feed stream into oxygen product and nitrogen byproduct gas streams and liquefying at least a portion of the nitrogen byproduct gas stream to yield a liquid nitrogen stream. A gas feed stream comprising methane and at least one lighter component having a lower boiling point than methane is obtained and cryogenically separated into a purified methane gas stream and a reject gas stream enriched in the lighter component. At least a portion of the required refrigeration for cryogenically separating the gas feed stream is provided directly by the liquid nitrogen stream. The oxygen product gas stream is reacted with at least a portion of the purified methane gas stream in a partial oxidation process to yield synthesis gas comprising hydrogen and carbon monoxide.

The liquid nitrogen stream can be provided by cooling the nitrogen byproduct gas stream and work expanding the resulting cooled stream to yield the liquid nitrogen stream and a cold nitrogen vapor stream, wherein the cooling of the nitrogen byproduct gas stream is effected by indirect heat exchange with the cold nitrogen vapor stream. The pressure of the nitrogen byproduct gas stream typically is at least 20 psia. Optionally, the nitrogen byproduct gas stream is compressed prior to cooling and work expanding.

The gas feed stream is separated by a process which comprises cooling the gas feed stream by indirect heat exchange with one or more cold process streams to yield a cooled fluid, work expanding the cooled fluid and introducing the resulting expanded fluid into a distillation column at an intermediate point, introducing the liquid nitrogen stream into the distillation column to provide cold reflux, withdrawing from the distillation column a cold overhead stream enriched in the lighter component and a purified liquid methane bottoms stream, and vaporizing the purified liquid methane bottoms stream to provide the purified methane gas stream.

The purified liquid methane bottoms stream optionally is pumped to an elevated pressure before vaporization to provide the purified methane gas stream. The gas feed stream may be cooled in part by indirect heat exchange with the purified liquid methane bottoms stream which vaporizes to yield the purified methane gas stream. The gas feed stream also can be cooled in part by indirect heat exchange with the cold overhead stream from the distillation column. In addition, the gas feed stream may be cooled in part by indirect heat exchange with a vaporizing liquid methane stream withdrawn from the bottom of the distillation column, wherein the resulting vaporized methane is used for boilup in the distillation column. If desired, a portion of the purified methane stream can be withdraw as a product prior to the partial oxidation process. The gas feed stream can be a natural gas feed stream, and the at least one lighter component in the natural gas feed stream usually comprises nitrogen.

The natural gas feed stream typically is provided by treating raw natural gas to remove contaminants which would freeze during cryogenic separation of the natural gas feed stream into a purified methane gas stream and a reject gas stream.

The lighter component in the gas feed stream can comprise nitrogen, and the cold overhead stream from the distillation column can be warmed by indirect heat exchange with the gas feed stream to yield a warmed nitrogen-rich reject stream. Optionally, a gas turbine system having a combustor and an expansion turbine can be operated to generate work for compressing the air feed stream for separation into the oxygen product and nitrogen byproduct gas streams. In this option, the warmed nitrogen-rich reject stream can be compressed and introduced into the combustor of the gas turbine system.

BRIEF DESCRIPTION OF THE DRAWING

The single FIGURE is a schematic process flowsheet which illustrates the present invention.

DETAILED DESCRIPTION OF THE INVENTION

The present invention is a method of integrating an air separation system and a partial oxidation system for the production of synthesis gas wherein the air separation system provides the oxygen for the partial oxidation process and byproduct nitrogen is utilized to generate refrigeration for pretreatment of the partial oxidation feed gas. The partial oxidation feed gas is predominantly methane, and typically is obtained from natural gas which contains lighter components such as nitrogen.

The invention is illustrated by the schematic process flowsheet in the single FIGURE. Air feed stream 1 is separated by known methods in cryogenic air separation system 3 to yield oxygen product stream 5 and nitrogen byproduct stream 7. Cryogenic air separation system 3 can utilize any known process cycle for air separation, and preferably utilizes an elevated pressure cycle which operates at an air feed pressure of at least 116 psia. Byproduct nitrogen stream 7 typically contains at least 96 mole % nitrogen and is at a pressure of at least 20 psia and near ambient temperature.

Gaseous methane stream 9 with a typical purity of 99.5 mole % methane is reacted with oxygen product stream 5 in partial oxidation system 11 to yield raw synthesis gas product stream 13 containing predominantly hydrogen and carbon monoxide. The purity of gaseous methane stream 9 may vary depending upon the source of the gas as discussed below. The required pressure of gaseous methane stream 9 will depend upon the operating pressure of downstream synthesis gas generating and consuming processes, and typically stream 9 will be in the range of 500 to 1500 psia. Partial oxidation system 11 utilizes any known partial oxidation process such as those developed by Texaco, Shell, Lurgi, Haldor-Topsoe, and others. Raw synthesis gas product stream 13 is further treated and utilized to synthesize hydrocarbon products such as Fischer-Tropsch liquids, methanol, dimethyl ether, and other oxygenated organic compounds.

Feed gas stream 15 contains methane and at least one component with a lower boiling point than methane. This feed gas typically is natural gas containing lower boiling components such as nitrogen and optionally helium which are present at a total concentration of about 1 to 15 mole %. Alternatively, the feed gas can be a blended gas from industrial sources such as petroleum refineries or petrochemical plants. Feed gas stream 15 is treated upstream (not shown) as necessary by known methods to remove water, carbon dioxide, heavier hydrocarbons, and sulfur compounds to prevent freezout of these components in the downstream cryogenic process described below.

Feed gas stream 15 typically at 500 to 1500 psia and ambient temperature is cooled in heat exchanger 17 against cold process streams 19, 21, and 23 (later defined) to yield condensed methane feed stream 25 at −265 to −285° F. Condensed methane feed stream 25 is work expanded through turboexpander 27 to yield reduced pressure methane feed stream 29 at 20 to 50 psia which is introduced at an intermediate point of distillation column 31.

Nitrogen byproduct stream 7 is further compressed by compressor 33 if necessary and cooled in heat exchanger 35 against cold process stream 37 (later defined) to yield cooled, compressed nitrogen stream 39 at 40 to 200 psia and −250 to −300° F. This stream is work expanded in turboexpander 41 to yield partially condensed nitrogen stream 43 at 20 to 50 psia and −280 to −320° F. which is separated in separator 45 to yield cold nitrogen vapor stream 37 and liquid nitrogen stream 47. Typically 2 to 10% of partially condensed nitrogen stream 43 is liquid. Cold nitrogen vapor stream 37 is warmed to cool nitrogen byproduct stream 7 in heat exchanger 35 as earlier described. Turboexpander 41 may be mechanically linked with compressor 33 in a compander arrangement (not shown) to utilize the work of expansion.

Liquid nitrogen stream 47 is introduced at or near the top of distillation column 31 to provide cold reflux for the separation of reduced pressure methane feed stream 29. The liquid nitrogen provides refrigeration for the system by direct contact with the methane-nitrogen mixture being separated in the distillation column and provides reflux to the column to improve the methane-nitrogen separation therein. A stream 23 of liquid methane is withdrawn from the bottom of the column and vaporized in heat exchanger 17 to provide a portion of the cooling for feed gas stream 15 as earlier described. The resulting methane vapor stream 49 is returned as boilup to distillation column 31.

Nitrogen overhead stream 19 is withdrawn therefrom and warmed in heat exchanger 17 to provide a portion of the cooling for feed gas stream 15 as earlier described. Warmed nitrogen reject stream 51, which contains residual methane, can be combined with other gaseous fuel streams in the synthesis gas production and downstream process areas. Distillation column 31 can be operated at an elevated pressure such that warmed nitrogen reject stream 51 is withdrawn at this elevated pressure. If desired, all or a portion of warmed nitrogen reject stream 51 can be compressed and injected into the combustor of a gas turbine which provides power to compress air in air separation system 3, to compress feed gas 15, or to drive downstream equipment. The utilization of the nitrogen reject stream in this manner recovers fuel value from the residual methane and also provides a diluent which improves combustion performance in the gas turbine.

Purified liquid methane bottoms stream 53, generally containing less than 0.5 mole % nitrogen, is pressurized to 500 to 1500 psia in pump 55 to provide pressurized liquid methane 21, which is vaporized in heat exchanger 17 to provide a portion of the cooling for feed gas stream 15 as earlier described. The resulting vaporized stream provides gaseous methane stream 9 to partial oxidation system 11 as earlier described. Work for driving pump 55 is provided by turboexpander 27 and supplemental motor drive 57 if necessary. If desired, a portion of gaseous methane stream 9 can be withdrawn as methane product stream 59.

EXAMPLE

Air separation system 3 utilizes an elevated pressure cycle which provides byproduct nitrogen stream 7 containing 99 mole % nitrogen at 60 psia. This stream is cooled in heat exchanger 35 to −278° F. and is work expanded to 20 psia across turboexpander 41 thereby cooling the stream to −315° F. and condensing 5% of the stream as liquid. The vapor fraction stream 37 warms in heat exchanger 35 to provide the cooling for byproduct nitrogen stream 7. Liquid nitrogen stream 47 provides cold reflux to distillation column 31.

Pretreated natural gas at 1000 psia, which is treated upstream to remove higher boiling components to prevent downstream freezout, provides feed gas stream 15 to heat exchanger 17. The stream is cooled to about −274° F. and is work expanded across turboexpander 27 to 20 psia to provide liquid feed to distillation column 31. Nitrogen overhead stream 19 containing 93 mole % nitrogen is withdrawn therefrom and warmed in heat exchanger 17 to provide cooling for feed gas stream 15. Liquid methane bottoms stream 53 containing 0.5 mole % nitrogen is pumped to 1000 psia by pump 55, vaporized in heat exchanger 17 to provide cooling for feed gas stream 15, and gaseous methane stream 9 is introduced into partial oxidation system 11 for partial oxidation to synthesis gas. 99.2% of the methane in feed gas stream 15 is recovered in gaseous methane stream 9. A stream summary for this Example is given in Table 1.

TABLE 1

Stream Summary for Example

| Stream Number | Temp. (° F.) | Pressure (psia) | Flow (Lbmol/hr) | Composition (mole %) Methane | Nitrogen | Argon | Oxygen |
|---|---|---|---|---|---|---|---|
| 7 | 85 | 60 | 100.0 | 0.0 | 99.0 | 0.5 | 0.5 |
| 9 | 44 | 1000 | 46.7 | 99.5 | 0.5 | 0.0 | 0.0 |
| 15 | 85 | 1000 | 48.8 | 96.0 | 4.0 | 0.0 | 0.0 |
| 38 | 75 | 18 | 94.9 | 0.0 | 99.1 | 0.5 | 0.4 |
| 47 | −315 | 20 | 5.1 | 0.0 | 97.3 | 1.1 | 1.5 |
| 51 | 44 | 17 | 7.2 | 5.3 | 92.8 | 0.8 | 1.1 |

Thus the process of the present invention utilizes the nitrogen byproduct of an air separation system which supplies oxygen to a partial oxidation synthesis gas process by providing refrigeration for pretreating the feed gas to the partial oxidation process. The nitrogen byproduct is liquefied and utilized directly as reflux in a distillation column which purifies the nitrogen-containing methane feed gas. An important feature of the invention is that the direct use of the liquid nitrogen as reflux eliminates the need for an overhead condenser on the distillation column and thus supplies refrigeration directly for the combined operation of heat exchanger 17 and distillation column 31. The removal of nitrogen from the feed gas to the partial oxidation process increases the effective partial pressure of methane in the partial oxidation reactor, decreases the volume of feed and product gas to be handled, and minimizes dilution of the synthesis gas used in downstream processes.

The essential characteristics of the present invention are described completely in the foregoing disclosure. One skilled in the art can understand the invention and make various modifications without departing from the basic spirit of the invention, and without deviating from the scope and equivalents of the claims which follow.

What is claimed is:

1. A method for producing synthesis gas which comprises:

(a) separating an air feed stream into oxygen product and nitrogen byproduct gas streams;

(b) liquefying at least a portion of the nitrogen byproduct gas stream to yield a liquid nitrogen stream;

(c) obtaining a gas feed stream comprising methane and at least one lighter component having a lower boiling point than methane;

(d) cryogenically separating the gas feed stream into a purified methane gas stream and a reject gas stream enriched in the lighter component wherein at least a portion of the required refrigeration for cryogenically separating the gas feed stream is provided by the liquid nitrogen of (b); and (e) reacting the oxygen product gas stream of (a) with at least a portion of the purified methane gas stream of (d) in a partial oxidation process to yield synthesis gas comprising hydrogen and carbon monoxide.

2. The method of claim 1 wherein the liquid nitrogen stream in (b) is obtained by cooling the nitrogen byproduct gas stream and work expanding the resulting cooled stream to yield the liquid nitrogen stream and a cold nitrogen vapor stream, wherein the cooling of the nitrogen byproduct gas stream is effected by indirect heat exchange with the cold nitrogen vapor stream.

3. The method of claim 2 wherein the pressure of the nitrogen byproduct gas stream is at least 20 psia.

4. The method of claim 2 wherein the nitrogen byproduct gas stream is compressed prior to cooling and work expanding.

5. The method of claim 1 wherein the gas feed stream is a natural gas feed stream.

6. The method of claim 5 wherein the lighter component in the natural gas feed stream comprises nitrogen.

7. The method of claim 5 wherein the natural gas feed stream is obtained by treating raw natural gas to remove contaminants which would freeze during cryogenic separation of the natural gas feed stream into a purified methane gas stream and a reject gas stream.

8. The method of claim 1 wherein the gas feed stream is separated by a process which comprises:

(i) cooling the gas feed stream by indirect heat exchange with one or more cold process streams to yield a cooled fluid;

(ii) work expanding the cooled fluid and introducing the resulting expanded fluid into a distillation column at an intermediate point;

(iii) introducing the liquid nitrogen stream of (b) into the top of the distillation column to provide cold reflux;

(iv) withdrawing from the distillation column a cold overhead stream enriched in the lighter component and a purified liquid methane bottoms stream; and (v) vaporizing the purified liquid methane bottoms stream to provide the purified methane gas stream of (d).

9. The method of claim 8 wherein the purified liquid methane bottoms stream is pumped to an elevated pressure before vaporization to provide the purified methane gas stream.

10. The method of claim 8 wherein the gas feed stream is cooled in part by indirect heat exchange with the purified liquid methane bottoms stream which vaporizes to yield the purified methane gas stream.

11. The method of claim 8 wherein the gas feed stream is cooled in part by indirect heat exchange with the cold overhead stream from the distillation column.

12. The method of claim 11 wherein the lighter component in the gas feed stream comprises nitrogen, and further wherein the cold overhead stream from the distillation column is warmed by indirect heat exchange with the gas feed stream to yield a warmed nitrogen-rich reject stream.

13. The method of claim 12 which further comprises operating a gas turbine system having a combustor and an expansion turbine to generate work for compressing the air feed stream for separation into the oxygen product and nitrogen byproduct gas streams.

14. The method of claim 13 wherein the warmed nitrogen-rich reject stream is compressed and introduced into the combustor of the gas turbine system.

15. The method of claim 8 wherein the gas feed stream is cooled in part by indirect heat exchange with a vaporizing liquid methane stream withdrawn from the bottom of the distillation column, wherein the resulting vaporized methane is used for boilup in the distillation column.

16. The method of claim 1 wherein a portion of the purified methane stream is withdraw as a product prior to the partial oxidation process.

* * * * *